US005725000A

United States Patent [19]

Rice

[11] Patent Number: 5,725,000

[45] Date of Patent: Mar. 10, 1998

[54] HAIR TWISTING DEVICE

[76] Inventor: Mary-Charlotte Rice, P.O. Box 1226, St. Thomas, Virgin Islands (U.S.), 00804

[21] Appl. No.: 622,765

[22] Filed: Mar. 14, 1996

[51] Int. Cl.[6] ..... A45D 24/00

[52] U.S. Cl. ..... 132/210; 132/107; 132/119.1; 15/104.04; 119/609; 119/664

[58] Field of Search ..... 132/200, 210, 132/107, 119.1, 237, 238, 239, 240, 241, 242; 15/104.04, 179, 180; 119/609, 650, 652, 664

[56] References Cited

U.S. PATENT DOCUMENTS

| | | | |
|---|---|---|---|
| 2,933,747 | 4/1960 | Higdon | 119/609 |
| 3,386,453 | 6/1968 | Roberts et al. | 132/119.1 |
| 3,750,680 | 8/1973 | Miller | 132/119.1 |
| 3,820,184 | 6/1974 | Stone | 15/104.04 |
| 3,863,652 | 2/1975 | Scivolette | 132/119.1 |
| 3,890,984 | 6/1975 | Lesetar | 132/238 |
| 3,892,246 | 7/1975 | Woodard . | |
| 4,026,307 | 5/1977 | Morrow . | |
| 4,084,282 | 4/1978 | Calvert | 119/609 |
| 5,211,132 | 5/1993 | Farina et al. | 119/664 |
| 5,240,017 | 8/1993 | Terwilliger | 132/145 |
| 5,249,589 | 10/1993 | Moore | 132/210 |
| 5,269,104 | 12/1993 | DiBiagio | 15/104.04 |
| 5,273,058 | 12/1993 | Edwards | 132/123 |
| 5,379,782 | 1/1995 | Tabb | 132/275 |

*Primary Examiner*—Todd E. Manahan

[57] ABSTRACT

A hair curling device (10) which curls hair in less time and with less effort than utilizing ones hands. The hair curling device (10) is specifically designed to comb and twist naturally curly (unprocessed) Afro-American hair, comprises a circular comb (14) having a plurality of comb teeth (14B) which rotates within a head (12). The hair curling device (10) can spin hair cowls (locks) in either direction. The hair curling device (10) is powered by an electric motor (18) which rotates the comb (14). The hair curling device (10) has a handle housing (16) which has a handle compartment (16D) within which the motor (18) (and power means (20)) is housed. The motor (18) has a motor gear (18A) which is complimentary to and engages a comb ring gear (14AA) mounted on an outer circumference of a comb ring (14A). On an inner circumference of the comb ring (14A) are the plurality of comb teeth (14B), with preferably two rows offset from each other. The hair curling device (10) has at least one handle switch (16C) capable of turning the hair curling device (10) ON and OFF as well as switching the comb rotation (14D) by changing the motor (18) direction.

9 Claims, 3 Drawing Sheets

HAIR TWISTING DEVICE

BACKGROUND OF THE INVENTION

1. Field of the Invention

The present invention relates to a hair curling device. More particularly, the present invention relates to hair curling device which curls hair in less time and with less effort than utilizing ones hands.

2. Description of the Prior Art

Hair curling devices are well known in the art. The majority are longitudinal and comb-like in configuration which have heating and/or steaming elements associated with them which function to retain the curl. Until the present invention, a comb specifically designed to comb and twist naturally curly (unprocessed) Afro-American hair has not been addressed. Afro-American hair has its own pattern of growth in which certain cowls of hair require clockwise or counter-clockwise twisting depending on how the cowl grew out. The present invention can spin hair cowls (locks) in either direction.

In U.S. Pat. No. 5,273,058, titled Hair Curling Device, invented by Syd Edwards, comprises a hair curling and styling tool including a shaft having first and second ends, a handle member extends outward from the first end, a hair curling member extending inward from the second end toward the handle portion, a hair brush carded in the shaft of the hair curling member, for aiding the curling of hair thereabout as the tool is rotated by the handle, apparatus for moving the hair brush from an operative position exterior the shaft to an in operative position interior the shaft to withdraw the bristles from the curl formed about the hair curling member, and an apparatus for temporarily mounting the hair fastener at the shaft second end, the hair fastener including first and second shanks of terminal length, the first shank including a straight portion and a second shank, having formed therein at least one sinusoidal curve, the shanks held together by a U-shaped connecting section, and an offset portion formed in the second shank, the holding device including apparatus for positioning the offset portion of the fastener such that the straight shank is aligned parallel to the shaft and slightly above the surface of the hair curling member for movement over a segment of the curl, formed about the hair curling member, parallel and adjacent to the scalp for placement out of sight in the hair style.

The patented invention creates a curled and rolled hair style that remains in place. The patented invention would function with straight hair. The present invention creates curls that hang free from the head. The present invention will function with artificially and naturally curly hair.

In U.S. Pat No. 5,249,589, titled Method for Setting a Hair Twist, invented by Melanie comprises a method of setting hair including the steps of pulling a full handful of there hair back at the nape of the neck, making a twist going up against the back of the head, making a plurality of twists against the head and moving them upward toward the top of the head and moving and into a roll having an edge. The top of the plurality of twists is then pinched so the roll will not loosen up and pushing the remaining hair under the roll. A particular hair comb is then placed, at a 90 degree angle to the head into the edge of the roll. Finally the top of the comb is turned downward toward the head while the comb teeth are pushed into the roll. This new method of setting the hair allows a person or a hair stylist to set hair in a neat, consistent and appealing fashion. This simple to learn method is cost effective and only requires a hair comb.

The patented invention is a device for retaining hair styled in a French Twist or and rolled curl, remaining in the hair after it is formed. It does not curl the hair. The present invention is a method of processing the hair into a curl that hangs free from the head. While the present invention has a comb, the comb is part of the invention and remains with the invention after the hair is curled.

In U.S. Pat. No. 5,240,517 titled, Braiding Comb invented by Gary Terwillinger comprises a comb for the formation of braids and similar hairstyles in professional hairdressing. One embodiment is a comb, having teeth of a spaced pattern common in the trade: extending out from the back of the comb for a substantial distance along the back of the comb is a flat, flexible bar, spaced a distance from the comb. Preferably, the spacing is tapered, being narrower at the point of attachment of the bar to the comb. This forms a tapered space for holding a section of hair, and aids in retaining the section of hair by the comb, permitting a hair dresser to separate a section of hair into the space, then allow the comb to hang free. In a second version of the comb, the flexible bar is in the form of a spring, a curved flexible bar fastened to one end of the comb, and extending in for form of a looped curve along the back to a pivot pin at the other end of the comb; the bar then is curved around the pin and extends back a distance along the comb to form the hair braid retention space. A clamp rides along the curve of the flexible barr. Movement of the clamp moves the extension closer to or away from the back of the comb, adjusting the spacing of the bar.

The patented invention is device for braiding the hair. It does not curl the hair. The present invention curls the hair. The present invention is a method of processing the hair into a curl that hangs free from the head. While the present invention has a comb, the comb is part of the invention and remains with the invention after the hair is curled.

In U.S. Pat. No. 5,379,782, titled Hair Fashion Accessory, invented by Birdie Tabb comprises; an improved hair fashion accessory having two long strips of material being formed into hollow tubes. The tubes are interlaced with one another. The ends of the tubes are attached to form a ring. An elastic band is disposed within the internal circumference thereby forming a hair twisty. Alternate embodiments of the invention, including a puffy hair attachment accessory, a dual color hair comb, and a twisty with an inner circumference free of material, are also disclosed.

The patented invention is a device for securing a ponytail hair style comprising primarily straight hair. The present invention curls the hair. The present invention is a method of processing the hair into a curl that hangs free from the head. While the present invention has a comb, the comb is part of the invention and remains with the invention after the hair is curled.

In U.S. Pat. No. 4,026,307, titled Afro Comb, invented by Morrow comprises; a comb adapted for curly and particularly kinky hair and utilizes teeth which are provided with notches or relieved portions along the sides thereof, such that adjacent teeth define hair-receiving channels which are other than parallel-sided, these channels being expanded along their length to define either generally serpentine shapes or having spaces substantially circular expanded areas along their length to facilitate the passage of curly hair therethrough, and an expanded area of the channels at the base of the teeth permits the accumulation therein of hair as it is combed, without resulting in wedging and binding, which ordinarily occurs at the juncture of the teeth with the spine, there also being a specialized arcuate bay in the comb handle having and expanded end to permit the simplified parting of the hair without the wedging of the hair as would be normal if a standard comb was used.

The patented invention is a device to comb kinky the hair without it jamming in the comb. The present invention curls the hair. The present invention is a method of processing the hair into a curl that hangs free from the head. While the present invention has a comb, the comb is part of the invention and remains with the invention after the hair is curled.

In U.S. Pat. No. 3,892,246, titled Method and Apparatus for Doing Afro Hairdos, invented by Robert Woodard comprises a method of processing hair to create an "Afro hairdo" Processed wet hair is held in place by a cap permeable by water vapor functioning to hold the hair in place until it drys. When the cap is removed it is then fluffed using a comb having greatly elongated teeth.

The patented invention is designed for curly hair and when processes in accordance with the process results in an enhancement of the hair style. The present invention curls the hair. The present invention is a method of processing the hair into a curl that hangs free from the head. While the present invention has a comb, the comb is part of the invention and remains with the invention after the hair is curled.

Numerous innovations for hair curling devices have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to hair curling device. More particularly, the present invention relates to hair curling device which curls hair in less time and with less effort than utilizing ones hands. The present invention is a hair curling device specifically designed to comb and twist naturally curly (unprocessed) Afro-American hair that has not been addressed. Afro-American hair has its own pattern of growth in which certain cowls of hair require clockwise or counter-clockwise twisting depending on how the cowl grew out. The present invention can spin hair cowls (locks) in either direction. The hair curling device is powered by an electric motor and the comb structure is configured in a circular pattern that twists a chosen lock of hair as it it pulled throughout the length of the lock. The user must determine which direction each lock of hair is twisted depending on the cowling. The hair curling device is manufactured from a material selected from a group consisting of plastic, plastic composites, metal, metal alloy, wood, fiberglass, epoxy and carbon-graphite. Preferably the hair curling device is constructed from plastic or plastic composite. The hair curling device has a handle housing which has a handle compartment within which a motor (and power means) is housed. The motor has a motor gear which is complimentary to and engages a comb ring gear mounted on an outer circumference of a comb ring having an approximate diameter of ¾ inches. On an inner circumference of the comb ring are a plurality of comb teeth, preferably ¼ inches in length, with preferably two rows offset from each other. The hair curling device has at least one switch capable of turning the device ON and OFF as well as switching the rotational direction of the motor.

The comb rotates within a head. The head is preferably in two parts being a left head and a right head which can hangably (not shown) open up to allow insertion of a lock of hair into the comb ring having a slit opening (not shown) therein. Since a lit opening enables strands of hair to get caught, it is not a preferred embodiment. An alternative embodiment of the preferred comb ring gear and the motor gear is a rotator belt (not shown) rotatably fastened to the motor and the comb ring. When a user desires to twist a lock of hair he/she pulls the entire lock of hair through the preferred embodiment one-piece comb ring, placing the device close to the skull. If the alternative hinged head device with a comb ring having a slit opening is utilized by the user, the lock of hair is selected and the device is placed around the base of the lock adjacent to the skull. In both uses, the lock of hair is held and the hair curling device is turned ON (after twisting direction has been determined by the user). The comb ring begins to rotate and concurrently, the lock of hair rotates. The hair curling device is then gently pulled away from the skull. The speed at which the comb turns is not significantly important because if the user wants tighter curls, he/she pulls away at a slower rate allowing more time for the twisting of the hair. The converse, loser curls, is also available by pulling the hair curling device at a faster rate. It is preferable for the user to wet his/her hair and utilize conditioner, curl activator or curl activator gel prior to utilizing the hair curling device.

The types of problems encountered in the prior art are present methods of curling Afro-American hair require a great deal of time and trouble.

In the prior art, unsucessful attempts to solve this problem were attempted namely: heated curling irons and longitudinally configured combs. However, the problem was solved by the present invention because it employs a rotational comb ring having a plurality of comb teeth attached thereto.

Innovations within the prior art are rapidly being exploited in the field of hair manipulation.

The present invention went contrary to the teaching of the art which teaches heated and/or steamed longitudinal curling members with or without comb teeth.

The present invention solved a long felt need to curl hair more rapidly in an automated manner and enable a person to curl all ones hair without the aid of another person.

The present invention produced unexpected results namely: twisting hair invigorated the scalp which reduced hair loss.

A synergistic effect was produced utilizing the present invention due to the following facts and results from experimentation: by utilizing the hair curling device, reduction of hair loss occurred and therefore, it is also a therapeutic device for treating hair follicles.

Accordingly, it is an object of the present invention to provide a hair curling device.

More particularly, it is an object of the present invention to provide a hair curling device which comprises a head having a comb which rotates therein.

In keeping with these objects, and with others which will become apparent hereinafter, one feature of the present invention resides, briefly stated, in the head can be one piece construction which is preferred or have an alternative embodiment which is two piece construction having a left head and a right head hangably (not shown) attached to a handle housing.

When the comb is designed in accordance with the present invention, it comprises a comb ring which is preferably without a slit opening. However, an alternative embodiment (not shown) has a comb ring with a slit opening which is used in conjunction with the two piece construction head.

In accordance with another feature of the present invention, the comb ring has a comb ring gear securely mounted on an exterior circumference.

Another feature of the present invention is that the comb ring gear has a complimentary motor gear to which it engages and functions to rotate the comb ring.

Yet another feature of the present invention is that an alternative drive mechanism to the preferred comb ring gear—motor gear is a rotator belt (not shown) which is attached to the motor and the comb ring functioning to rotate the comb ring in conjunction with motor rotation.

Still another feature of the present invention is that the comb ring has a plurality of comb teeth positioned around an inner circumference of the comb ring.

Yet still another feature of the present invention is that each comb tooth has a comb tooth point.

Still yet another feature of the present invention is that the comb ring has a comb opening through which a user pulls a lock of hair to commence the twisting process.

Another feature of the present invention is that the handle housing comprises a handle shaft.

Yet another feature of the present invention is that the head is securely fastened to a top distal end of the handle shaft.

Still another feature of the present invention is that handle housing further comprises a handle compartment within which a motor (and power means) is located.

Yet still another feature of the present invention is that handle housing further comprises a removable handle cover which functions to cover and allow access to the handle compartment.

Still yet another feature of the present invention is that the motor has a motor positive lead and a motor negative lead which are electronically connected to the power means.

Another feature of the present invention is that a handle switch is electronically connected between the power means and the motor.

Yet another feature of the present invention is that handle switch can turn the hair curling device ON and OFF as well as change rotational direction of the motor.

Still another feature of the present invention is that a method of using a hair curling device is disclosed herein in detail.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

Preferred Embodiment

10—hair curling device (10)
12—head (12)
12L—left head (12L)
12R—right head (12R)
14—comb (14)
14A—comb ring (14A)
14AA—comb ring gear (14AA)
14B—comb tooth (14B)
14BA—comb tooth point (14BA)
14C—comb opening (14C)
14D—comb rotation (14D)
16—handle housing (16)
16A—handle shaft (16A)
16B—handle cover (16B)
16C—handle switch (16C)
16D—handle compartment (16D)
18—motor (18)
18A—motor gear (18A)
18P—motor positive lead (18P)
18N—motor negative lead (18N)
20—power means (20)

Method of Utilizing the Preferred Embodiment

100—method of using a hair curling device (10)
112—securing (112) a lock of hair by a user
114—pulling (114) the lock of hair through a comb opening (14C) of the comb (14) which is rotatably mounted with the hair curling device (10), the comb (14) having a plurality of comb teeth (14B) engage hair strands of the lock of hair
116—activating (116) a handle switch (16C) by the user which rotates the comb (14) and concurrently rotates the comb teeth (14B) which in turn rotates the hair strands of the lock of hair and concurrently rotates the lock of hair
118—moving the comb (14) in an outward direction away from a user's skull along a length of the lock of hair until a distal end is reached and the lock of hair disengages from the comb (14)

DETAILED DESCRIPTION OF THE PREFERRED EMBODIMENT

Figure 1:
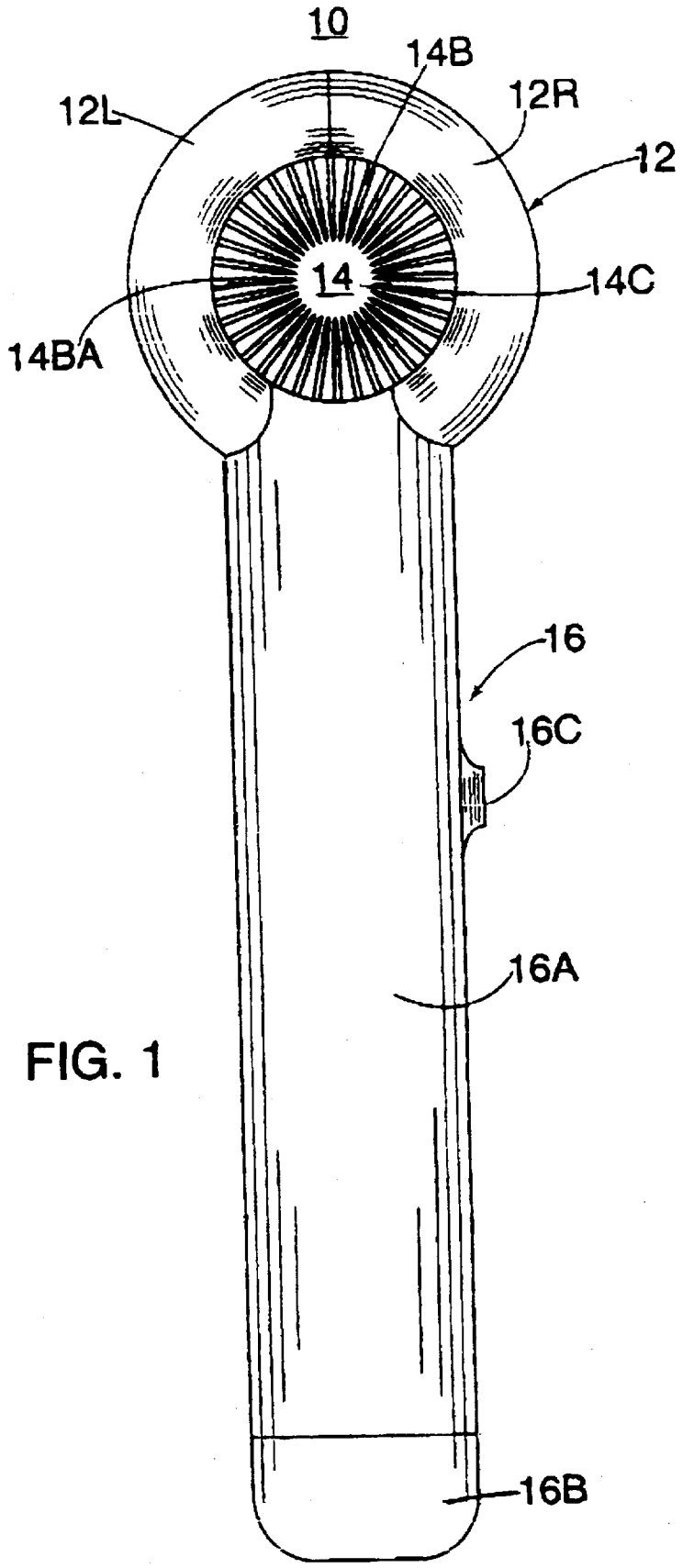
FIG. 1 is a front view of a hair curling device exhibiting a comb rotatably mounted within a head which is securely mounted on a handle housing.

Firstly, referring to FIG. 1 which is a front view of a hair curling device (10) exhibiting a comb (14) rotatably mounted within a head (12) which is securely mounted on a handle housing (16). The head (12) can be manufactured as a one piece unit or preferably a two piece unit having a left head (12L) and a right head (12R). Within the head (12), the comb (14) consisting of a comb ring (14A) having a comb ring gear (14AA) securely mounted on an outer circumference, is rotatably mounted. The comb ring (14A) has a plurality of comb teeth (14B) securely fastened on an inner circumference. Each comb tooth (14B) has a comb tooth point (14BA) positioned at its inner distal end. The plurality of comb teeth (14B) do not extend fully into the middle of the comb ring (14A) and are shorter in length, thus, producing a comb opening (14C) through which a user pulls locks of hair to be curled by the hair curling device (10). The handle housing (16) consists of a handle shaft (16A) which is securely fastened at an upper distal end to the head (12). At a lower distal end of the handle shaft (16A), a handle cover (16B) is removably mounted thereon. A handle switch (16C) is preferably mounted on the handle housing (16).

Figure 2:
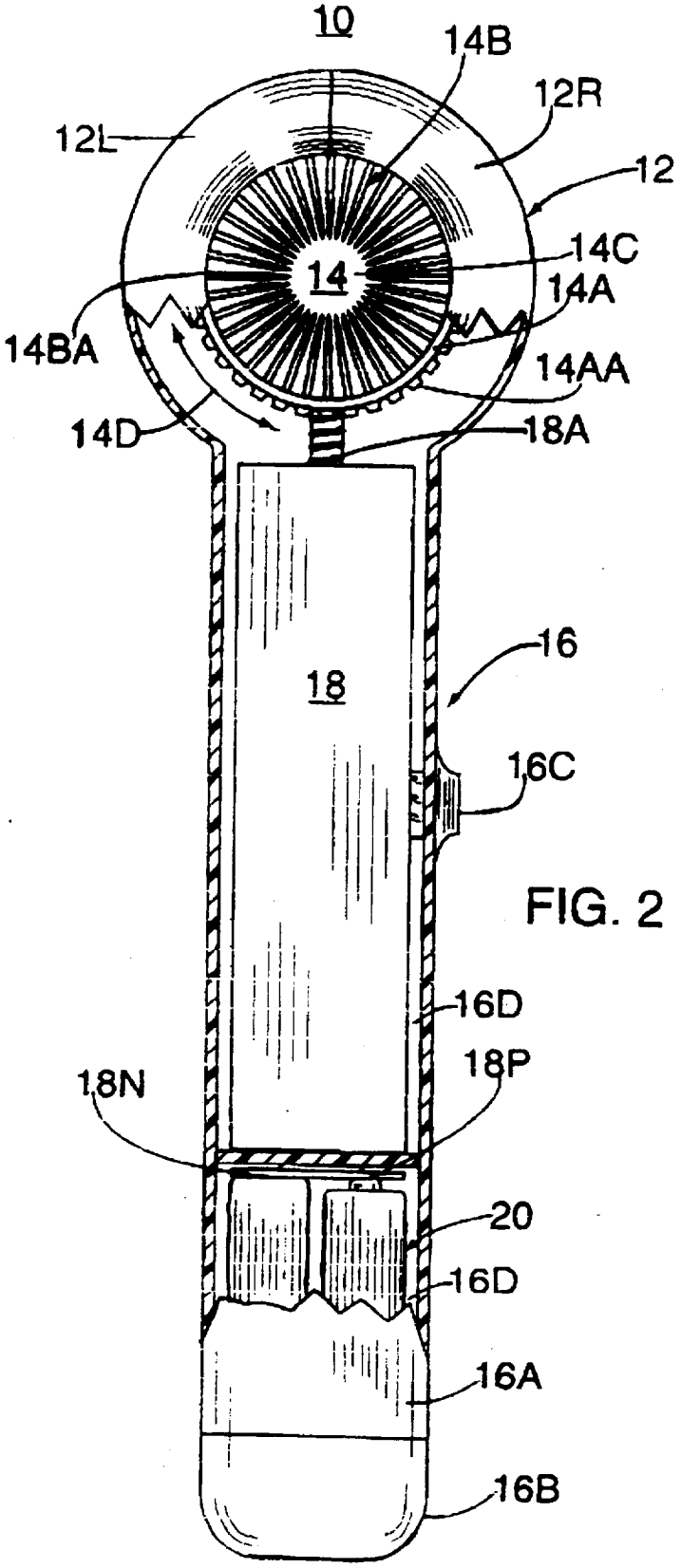
FIG. 2 is a front partial cross-sectional view of a hair curling device exhibiting the comb having a comb ring with a comb ring gear being rotated by a complimentary motor gear of a motor.

Secondly, referring to FIG. 2 which is a from partial cross-sectional view of a hair curling device (10) exhibiting the comb (14) having a comb ring (14A) with a comb ring gear (14AA) being rotated by a complimentary motor gear (18A) of a motor (18). The handle housing (16) is preferably hollow having a handle compartment (16D) contained therein. Within the handle compartment (16D), a motor (18) and a power means (20) are located. The power means (20) is electronically connected to the motor (18) by a motor positive lead (18P) and a motor negative lead (18N). The handle switch (16C) is electronically connected between the power means (20) and the motor (18). The handle switch (16C) functions to activate comb rotation (14D) in a clockwise or counter-clockwise direction.

The comb ring gear (14AA) is complimentary to and intersects with the motor gear (18A) which is rotatably connected to the motor (18). When the motor (18) is activated to rotate the motor gear (18A) in one direction, the comb ring gear (14AA) and hence the comb (14) is rotated in a complimentary direction. When the motor (18) is activated to rotate the motor gear (18A) in an opposite direction, the comb ring gear (14AA) and hence the comb (14) is rotated in a complimentary opposite direction.

The hair curling device (10) functions to curl a lock of a user's hair by the user pulling a lock of hair completely through the comb (14) whereas the head (12) is in a close distance from a user's skull. The user then activates comb rotation (14D) by positioning the handle switch (16C) in a desired rotational direction position. The plurality of comb teeth (14B) engage individual hair strands within the lock of hair and rotate the entire lock of hair. The user slowly moves the head (12) away from the user's skull until the head (12) reaches the distal end of the lock of hair. Thus, the hair lock is curled.

Figure 3:
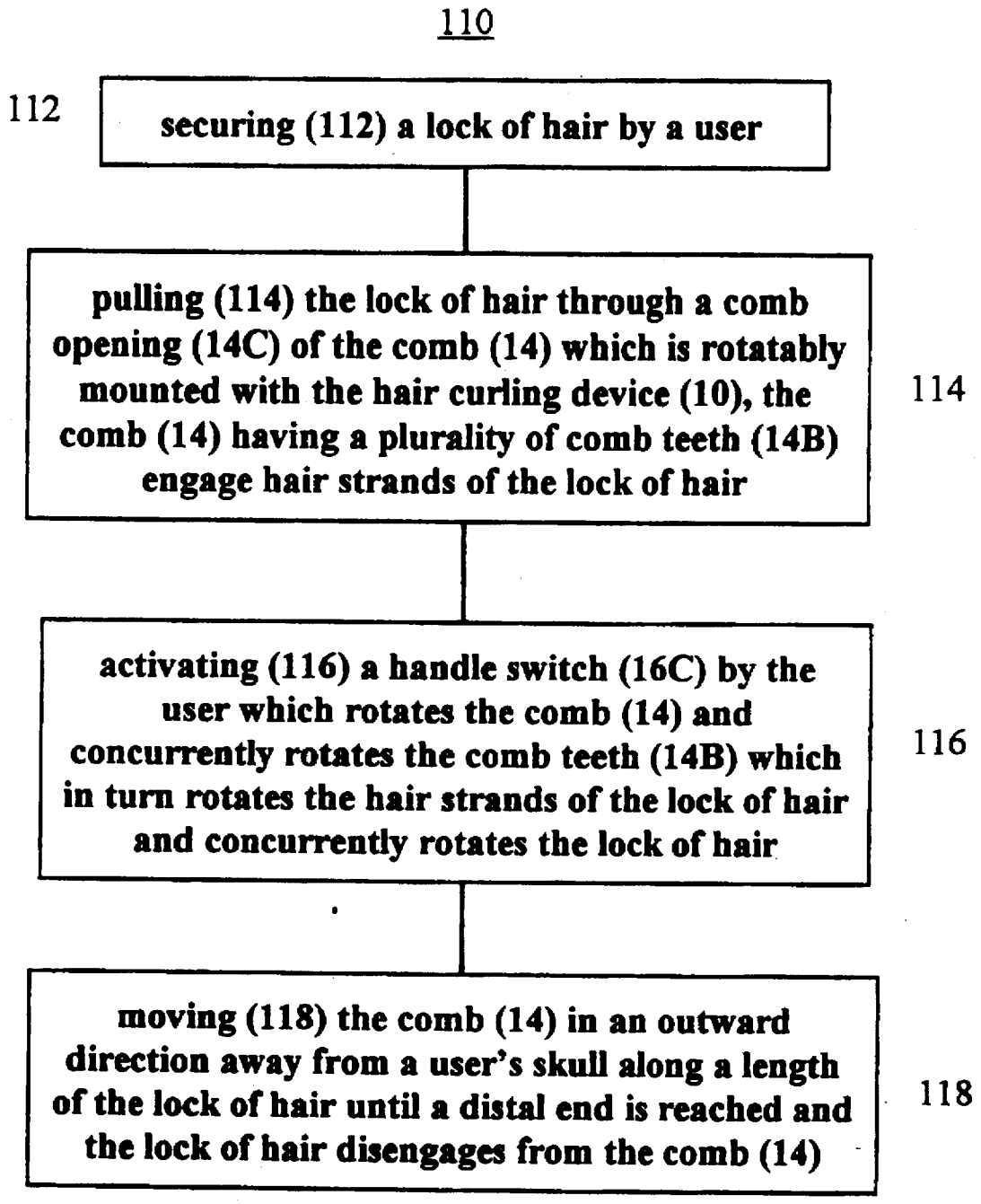
FIG. 3 is a diagrammatic representation of a method of using a hair curling device.

Lastly, referring to FIG. 3 which is a diagrammatic representation of a method of using a hair curling device (10) exhibiting the following steps:

A) securing (112) a lock of hair by a user;

B) pulling (114) the lock of hair through a comb opening (14C) of the comb (14) which is rotatably mounted with the hair curling device (10), the comb (14) having a plurality of comb teeth (14B) engage hair strands of the lock of hair;

C) activating (116) a handle switch (16C) by the user which rotates the comb (14) and concurrently rotates the comb teeth (14B) which in turn rotates the hair strands of the lock of hair and concurrently rotates the lock of hair; and D) moving the comb (14) in an outward direction away from a user's skull along a length of the lock of hair until a distal end is reached and the lock of hair disengages from the comb (14).

It will be understood that each of the elements described above, or two or more together, may also find a useful application in other types of constructions differing from the type described above.

While the invention has been illustrated and described as embodied in a hair curling device, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hair curling device consisting essentially of:

an annular comb housing having a circular central aperture forming a passage therethrough, said comb housing comprising two symmetrical pieces forming a right half and a left half of said comb housing, respectively;

an annular comb secured within said housing having a plurality of teeth which project into said passage of said comb housing, each of said teeth having a length shorter than the radius of said central aperture of said comb housing so as to provide a comb opening within said passage;

a handle housing secured to said comb housing and extending radially therefrom, said handle housing having a handle compartment formed therein and a removable cover for selectively closing said compartment;

an electric motor disposed within said handle compartment, said motor being operatively connected to said annular comb so as to cause rotation of said comb within said comb housing; and a power supply disposed within said handle compartment and electrically connected to said motor.

2. The hair curling device as described in claim 1, wherein said power supply is connected to said motor by a motor positive lead and a motor negative lead.

3. The hair curling device as described in claim 2, wherein said power supply is further connected to said motor by a switch which is disposed on said handle housing.

4. The hair curling device as described in claim 3, wherein said switch is a reversing switch which selectively causes said comb to rotate in either a clockwise or a counterclockwise direction.

5. The hair curling device as described in claim 1, wherein said motor is connected to said comb by a motor gear.

6. The hair curling device as described in claim 5, wherein said annular comb comprises a comb ring having a comb ring gear securely affixed about the periphery thereof, said comb ring gear being complimentary with and engaged by said motor gear.

7. The hair curling device as described in claim 1, wherein said power supply comprises a battery.

8. The hair curling device as described in claim 1, wherein the comb housing, the handle housing, and the comb are manufactured from a group of materials consisting of plastic, plastic composite, fiberglass, epoxy, carbon-graphite, metal, metal alloy, and wood.

9. A method of curling hair using a hair curling device (10), said hair curling device comprising and annular comb housing having a circular central aperture forming a passage therethrough, said comb housing comprising two symmetrical pieces forming a right half and a left half of said comb housing, respectively; and annular comb secured within said housing having a plurality of teeth which project into said passage of said comb housing, each of said teeth having a length shorter than the radius of said central aperture of said comb housing so as to provide a comb opening within said passage; a handle housing secured to said comb housing and extending radially therefrom, said handle housing having a handle compartment formed therein and a removable cover for selectively closing said compartment; an electric motor disposed within said handle compartment, said motor being operatively connected to said annular comb so as to cause rotation of said comb within said comb housing; and a power supply disposed within said handle compartment and electrically connected to said motor, said method comprising the steps of:

securing a lock of hair by a user;

pulling the lock of hair through the passage in said comb housing and said comb opening such that said comb is disposed around the lock of hair with the comb teeth engaging the lock of hair;

activating the motor of the hair curling device so as to cause said comb to rotate thus twisting the lock of hair; and moving the hair curling device outwardly away form the user along the length of the lock of hair while said comb is rotating until the lock of hair disengages from the comb.

* * * * *